US009439486B2

(12) United States Patent
Lieblein

(10) Patent No.: US 9,439,486 B2
(45) Date of Patent: Sep. 13, 2016

(54) PERSONAL ELECTRONIC CARRYING AND CHARGING DEVICE

(71) Applicant: Corey Lieblein, Port Washington, NY (US)

(72) Inventor: Corey Lieblein, Port Washington, NY (US)

(73) Assignee: INNOVATIVE TECHNOLOGY ELECTRONICS, LLC, Wilmington, DE (US)

( * ) Notice: Subject to any disclaimer, the term of this patent is extended or adjusted under 35 U.S.C. 154(b) by 439 days.

(21) Appl. No.: 14/160,501

(22) Filed: Jan. 21, 2014

(65) Prior Publication Data

US 2014/0202888 A1 Jul. 24, 2014

Related U.S. Application Data

(60) Provisional application No. 61/754,717, filed on Jan. 21, 2013.

(51) Int. Cl.
*A45C 11/00* (2006.01)
*A45C 13/02* (2006.01)

(52) U.S. Cl.
CPC ..... *A45C 11/00* (2013.01); *A45C 2011/003* (2013.01); *A45C 2013/025* (2013.01)

(58) Field of Classification Search
CPC ..... A45C 11/00; H02J 7/0042; H02J 7/0044; H02J 7/0045
USPC ..... 206/45.23, 320; 190/119–121; 320/101, 320/107, 113–115; 361/679.55–679.59, 361/680, 686; 455/90.3
See application file for complete search history.

(56) References Cited

U.S. PATENT DOCUMENTS

| | | | | | |
|---|---|---|---|---|---|
| 2,320,166 | A * | 5/1943 | Arnold | A45C 11/008 | 190/119 |
| 3,605,961 | A * | 9/1971 | Marrion | A45C 13/10 | 190/120 |
| 6,046,571 | A * | 4/2000 | Bovio | H02J 7/0042 | 320/107 |
| 8,281,924 | B2 * | 10/2012 | Westrup | A45C 3/02 | 206/320 |
| 2007/0177343 | A1 * | 8/2007 | Hsia | G06F 1/1656 | 361/679.55 |
| 2007/0177344 | A1 * | 8/2007 | Hsia | G06F 1/1656 | 361/679.55 |
| 2010/0315041 | A1 * | 12/2010 | Tan | H02J 7/0044 | 320/115 |
| 2010/0317412 | A1 * | 12/2010 | Tan | H02J 7/0044 | 455/573 |
| 2010/0317413 | A1 * | 12/2010 | Tan | H02J 7/0044 | 455/573 |

* cited by examiner

*Primary Examiner* — Bryon Gehman
(74) *Attorney, Agent, or Firm* — White-Welker & Welker, LLC; Matthew T. Welker, Esq.

(57) ABSTRACT

A device for protecting and carrying a personal electronic tablet device. The carrying device having an internal battery whereby a personal electronic tablet device is coupled to the battery of the carrying device to power and/or charge the personal electronic tablet device and one or more additional mobile devices.

17 Claims, 7 Drawing Sheets

PERSONAL ELECTRONIC CARRYING AND CHARGING DEVICE

CROSS REFERENCE TO RELATED APPLICATIONS

This application claims priority from U.S. Patent Application Ser. No. 61/754,717, entitled "Personal Electronic Carrying and Charging Device", filed on 21 Jan. 2013. The benefit under 35 USC §119 of the U.S. provisional application is hereby claimed, and the aforementioned application is hereby incorporated herein by reference.

FEDERALLY SPONSORED RESEARCH:

Not Applicable

SEQUENCE LISTING OR PROGRAM:

Not Applicable

TECHNICAL FIELD OF THE INVENTION

The present invention relates generally to a device for protecting and carrying a personal electronic tablet device. More specifically, the present invention relates to a carrying device having an internal battery whereby a personal electronic tablet device is coupled to the battery of the carrying device to power and/or charge the personal electronic tablet device.

BACKGROUND OF THE INVENTION

In recent years, handheld electronic tablet devices have become common place and well integrated into every aspect of life. Electronic tablet devices have become smaller and more mobile, and the number of electronic tablet devices that a person carries with them has greatly increased in the last few years. In particular, features such as multimedia, web browsing, electronic mail, mobile applications, and telecommunications have become increasingly accessible and mobile through the use of smartphones and tablet computers.

The mobility of these personal electronic tablet devices is made possible due to batteries located within each electronic tablet device. Some of the mobile devices have removable rechargeable batteries where the battery is placed into a docking station to be recharged, or alternatively is recharged while located within the device. Others have internal rechargeable batteries which are recharged while located within the device. Batteries are generally provided with a limited capacity thereby requiring a user to charge the personal electronic tablet device often. For some electronic tablet devices with bright or high definition displays, continual use of the electronic tablet device requires that be charged frequently throughout the day.

Many users of electronic tablet devices have a need to transport and/or protect such devices. In addition, such devices generally include internal batteries that must be charged regularly. Thus, there is a need for a storage case that is able to protect the devices during storage or transport while also allowing the user to access and charge the device.

Thus, while various systems and devices currently exist for mobile charging of personal electronic tablet devices, substantial challenges still exist. Accordingly, it would be an improvement in the art to augment or even replace current mobile charging systems or techniques with other systems and or techniques.

SUMMARY OF THE INVENTION

A first interior surface is used for securing the case to the electronic tablet device. The electronic tablet device can be secure by compression fitting, straps, or other means known in the art for device cases. A second interior surface, in some embodiments, is covered with a protective flap for hiding charging cables and preventing scratches to the electronic tablet device's display screen when the case is in a closed position. When open, the case may be folded in half or have an integrated stand on an outer surface for holding the case and electronic tablet device and display screen at an angle on a flat surface. To use the charging cables, the flap is simply opened to obtain access to them and they are plugged into a corresponding device.

The case features a portable 3500 mAh-17,000 mAh battery integrated into the case. The case's built in rechargeable battery delivers 10-90 hours of charging. In on embodiment the case is a lightweight, stylish synthetic leather case that can provide charging for two or more devices at once via a 30-PIN, lightening, and USB connections. The case keeps all buttons, ports, cameras, and other accessories accessible, while retain the electronic tablet device securely. The built-in battery is quickly and easily recharged via a use cable. In some embodiments, the battery can take up to eight hours to recharge.

BRIEF DESCRIPTION OF THE DRAWINGS

The accompanying drawings, which are incorporated herein an form a part of the specification, illustrate the present invention and, together with the description, further serve to explain the principles of the invention and to enable a person skilled in the pertinent art to make and use the invention.

DETAILED DESCRIPTION OF THE INVENTION

In the following detailed description of the invention of exemplary embodiments of the invention, reference is made to the accompanying drawings (where like numbers represent like elements), which form a part hereof, and in which is shown by way of illustration specific exemplary embodiments in which the invention may be practiced. These embodiments are described in sufficient detail to enable those skilled in the art to practice the invention, but other embodiments may be utilized and logical, mechanical, electrical, and other changes may be made without departing from the scope of the present invention. The following detailed description is, therefore, not to be taken in a limiting sense, and the scope of the present invention is defined only by the appended claims.

In the following description, numerous specific details are set forth to provide a thorough understanding of the invention. However, it is understood that the invention may be practiced without these specific details. In other instances, well-known structures and techniques known to one of ordinary skill in the art have not been shown in detail in order not to obscure the invention. Referring to the figures, it is possible to see the various major elements constituting the apparatus of the present invention.

Now referring to the figures, the embodiment of the case 1 with a built in rechargeable battery and multiple cables 12-14 is shown.

Figure 1:
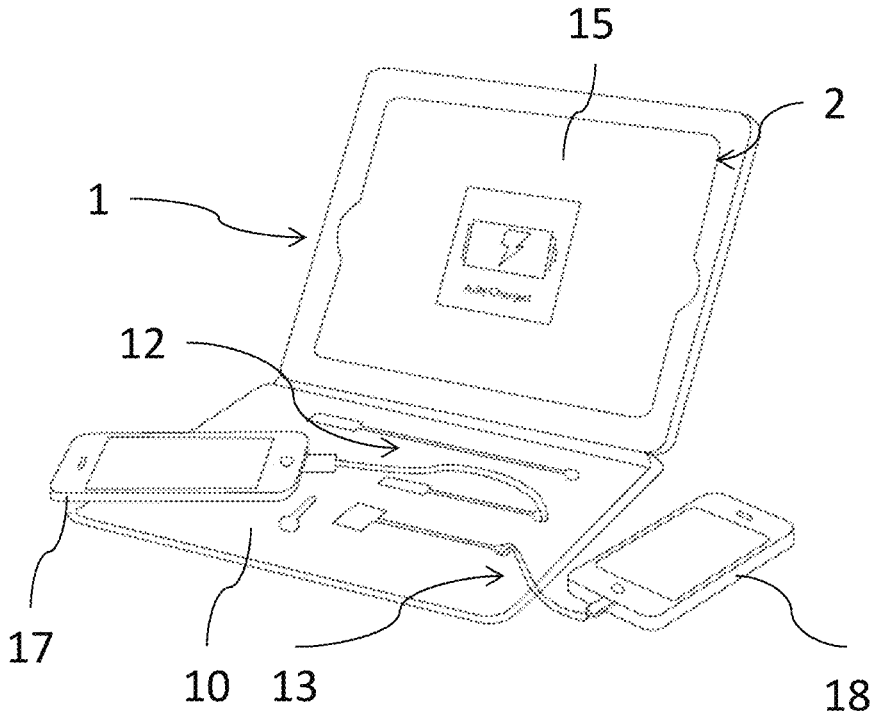
FIG. 1 illustrates a mobile electronic tablet devices case with a built in rechargeable battery and a plurality of charging cables with alternative angle adjustment means.
Figure 3:
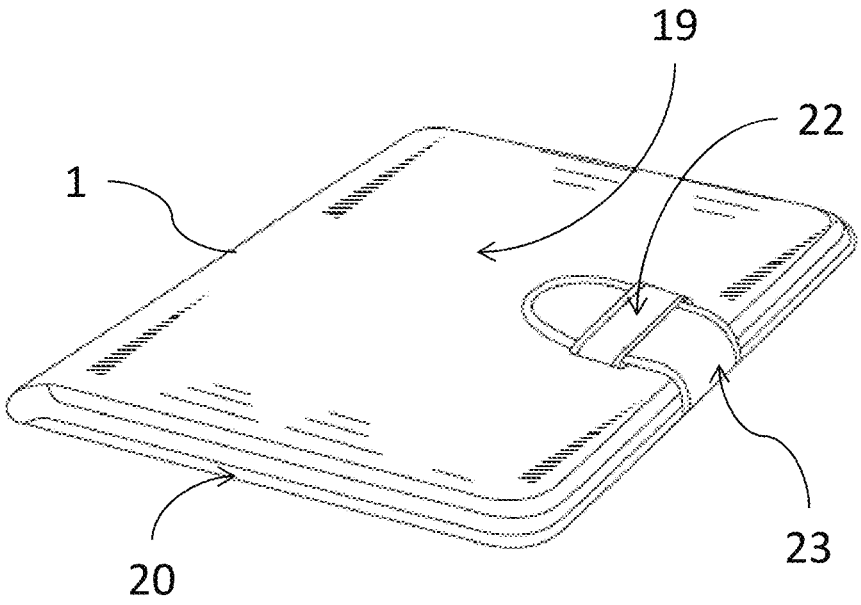
FIG. 3 illustrates the mobile electronic tablet devices case in a closed position.
Figure 11:
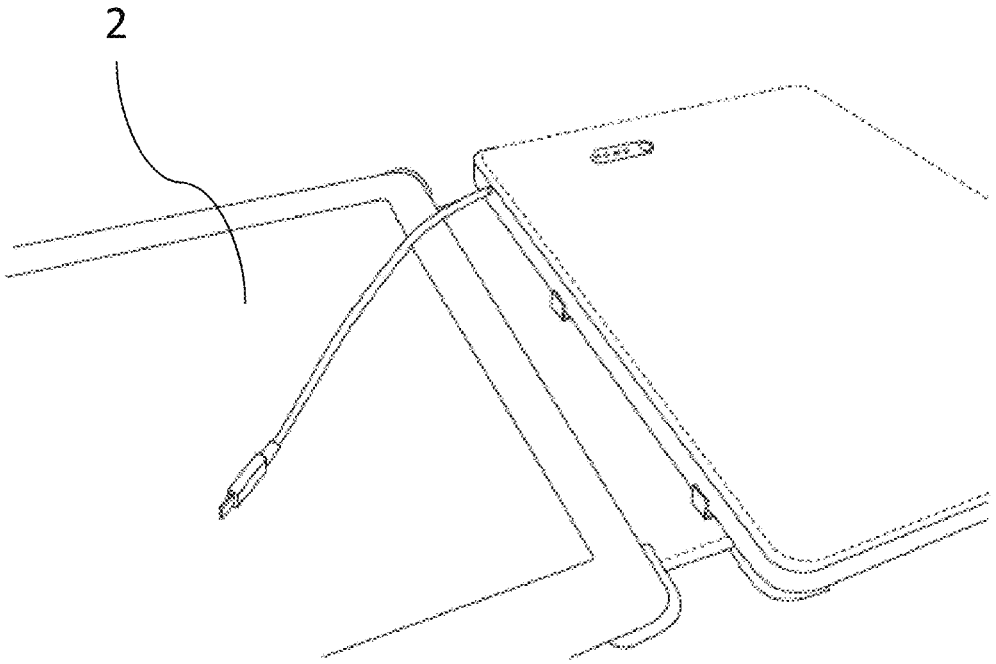
FIG. 11 illustrates the mobile electronic tablet devices case in an open position, additional charging cable connected to the battery.

Now referring to FIGS. 1, 3, and 11, a table computer case 1 for table computers such as the IPAD, KINDLE, MICROSOFT SURFACE, and other similar devices is show as one embodiment of the case 1 of the present invention. In this embodiment, the case 1 is a bi-fold design for protecting and charging an electronic tablet device 2. The electronic tablet devices 2 include mobile telephones, personal digital assistants, tablets, c-readers, laptops, cameras, portable navigation systems, personal digital music players, handheld game consoles, and the like. It is appreciated that the case 1 of the present invention can be made of any size or configuration in bi-fold or tri-fold embodiment to retain any electronic tablet devices 2 in the market place.

As shown in FIG. 3, when the case 1, is in a closed position, the two sides 19 and 20 are together creating one external surface 21. On one end of a side is a loop 22 for retaining a strap 23 that is secured to the opposing side. In a closed position the strap 23 can be inserted into the loop 22 for securing and closing the case 1. Other embodiments for securing such as one or more buttons, belts, zippers, etc. are well known in the art and can be used to secure the opposing ends of the two sides.

Figure 8:
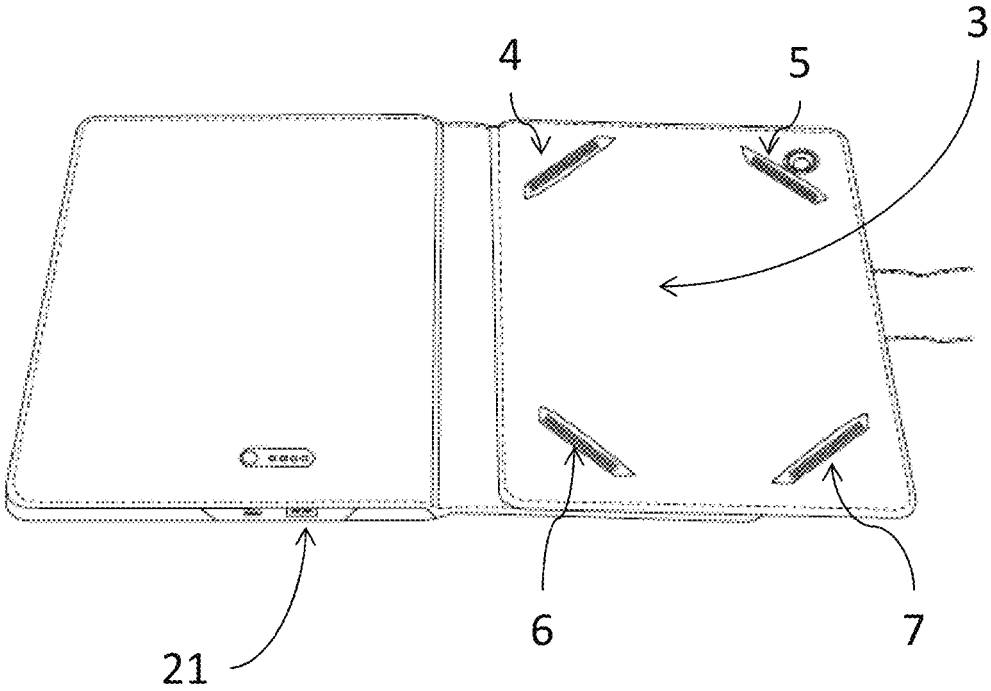
FIG. 8 illustrates the mobile electronic tablet devices case in an open position, with the four corner retaining supports.
Figure 9:
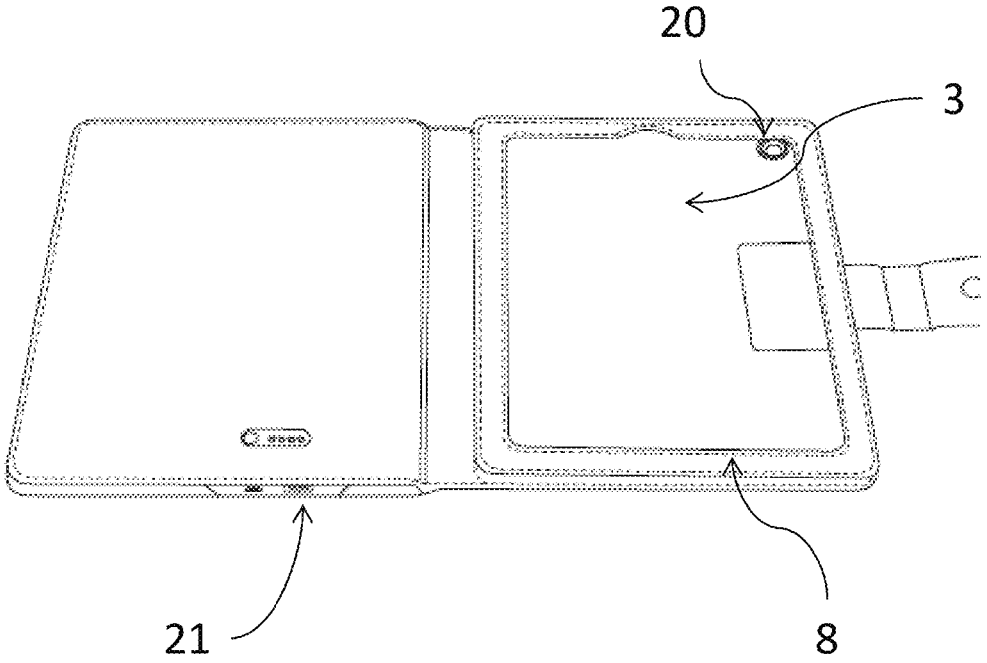
FIG. 9 illustrates the mobile electronic tablet devices case in an open position, with a perimeter retaining support.
Figure 10:
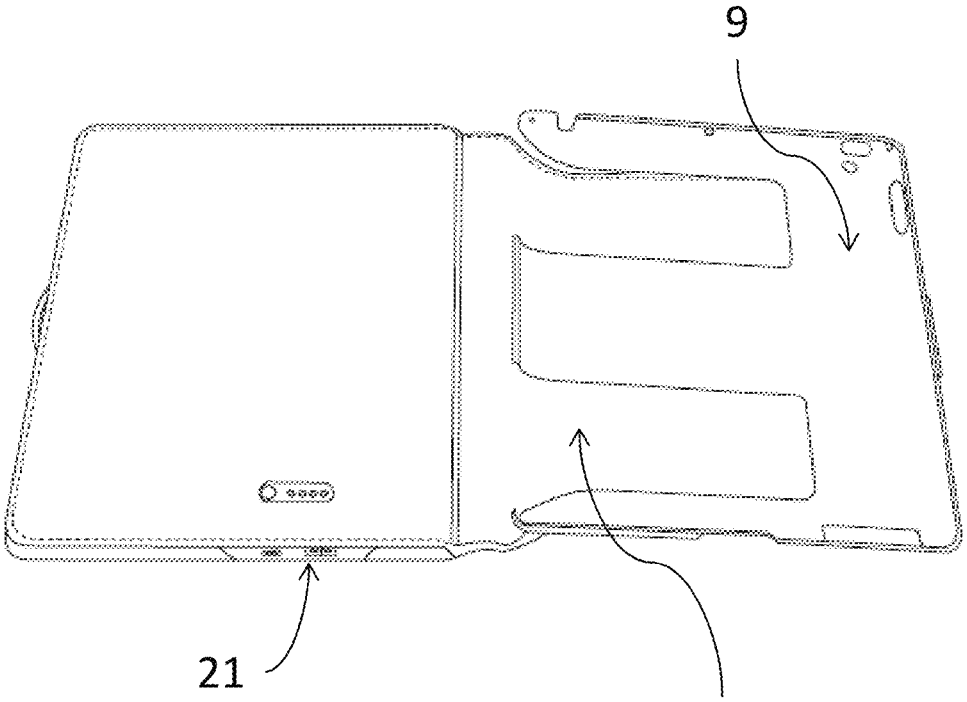
FIG. 10 illustrates the mobile electronic tablet devices case in an open position, with a slide in retaining support.

Now referring to FIGS. 8-10, a first interior surface 3 is used for securing the case the electronic tablet device 2. The electronic tablet device can be secure by a compression fitting 8 which extends around the entire surface of the electronic tablet device 2 and secures the electronic tablet device 2 against the interior surface 3 and provides compression force all around the entire surface of the electronic tablet device 2 as show in FIG. 9. As shown in FIG. 8, straps 4-7 are placed at each corner of a square or rectangular device can be sued to secure each corner and hold the electronic tablet device 2 against the interior surface 3.

FIG. 10 illustrates an embodiment where a rigid panel 9 is used in combination with the interior surface 3 to hold the electronic tablet device 2 against the interior surface 3 and have it securely retained within the rigid panel 9, which would provide greater protection from impacts compared to a fabric design of the other embodiments. The rigid panel 9 could be made from a plastic material to provide greater impact protection, but also enable enough stretch and bend to secure an electronic tablet device 2 to it by compression forces between the edge of the rigid panel 9 and the edge/side of the electronic tablet device 2.

Figure 2:
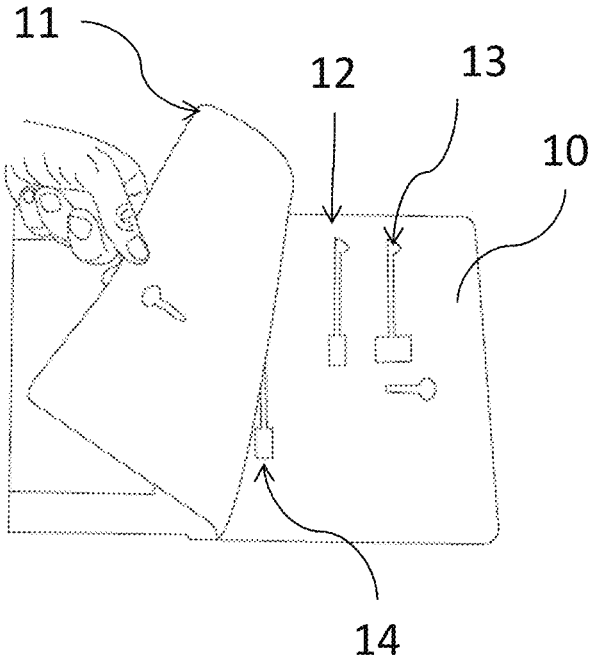
FIG. 2 illustrates the interior panel for retaining and storing a plurality of charging cables.

Now referring to FIG. 2, in some embodiments, a second interior surface 10 is covered with a protective flap 11 for hiding charging cables 12-14 and preventing scratches to the electronic tablet device's display screen 15 when the case is in a closed position. When open, the case 2 may be folded in half or have an integrated stand 16 on an outer surface for holding the case 1 and electronic tablet device 2 and display screen 15 at an angle on a flat surface as show in FIG. 4. To use the charging cables 12-14, the flap 11 is simply opened to obtain access to use the charging cables 12-14 and use the charging cables 12-14 are plugged into a corresponding device 17 and 18.

Figure 12:
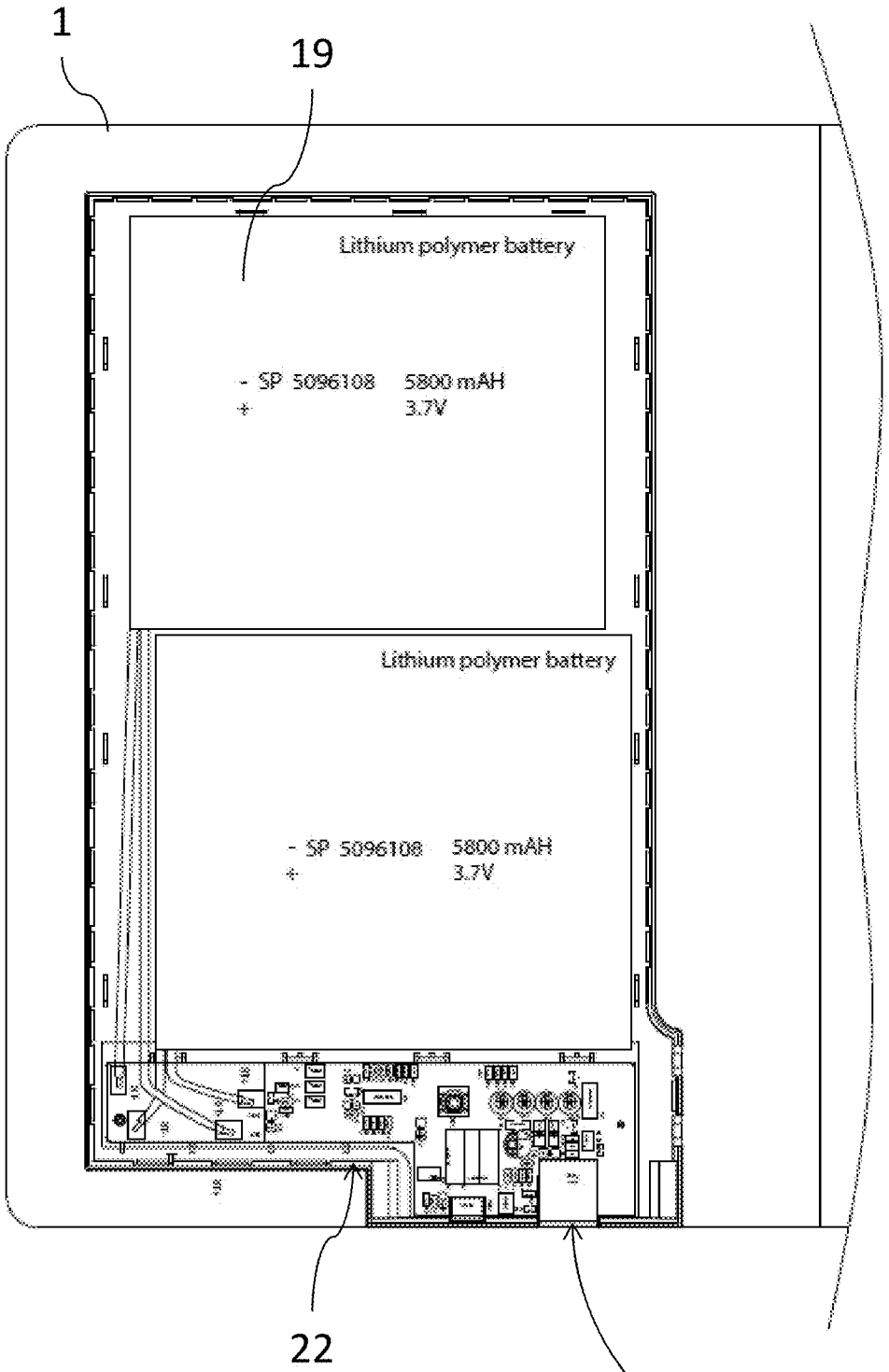
FIG. 12 illustrates the internal view of the battery storage portion of the mobile electronic tablet devices case which includes two battery cells and a PCB for controlling charging and providing plugs.

Now referring to FIG. 12, the case 1 features a portable, rechargeable 3500 mAh-17,000 mAh battery 19 integrated into the case 1. The case's built in rechargeable battery 19 delivers 10-90 hours of charging. In one embodiment the case 1 is a lightweight, stylish synthetic leather case that can provide charging for two or more devices 2 at once via 30-PIN, lightening, and USB connections represented by the charging cables 12-14. The case 1 keeps all buttons, ports, cameras, and other accessories accessible by providing access holes 20 such as that shown for a typical camera placement on an electronic device 2, while retaining the electronic tablet device 2 secured. The built-in battery 19 is quickly and easily recharged via a USB or other charging cable 21. A printed circuit board (PCB) is connected to the battery 19 to control charging and power distribution to other devices connected to the charging cables 12-14.

Figure 4:
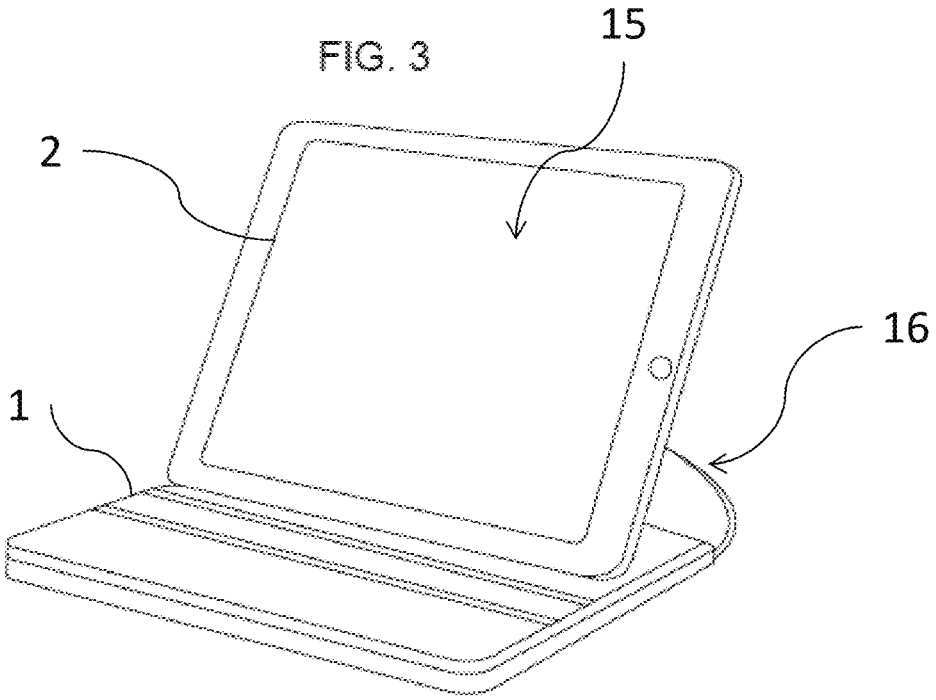
FIG. 4 illustrates the mobile electronic tablet devices case in an open position, with alternative angle adjustment means.
Figure 5:
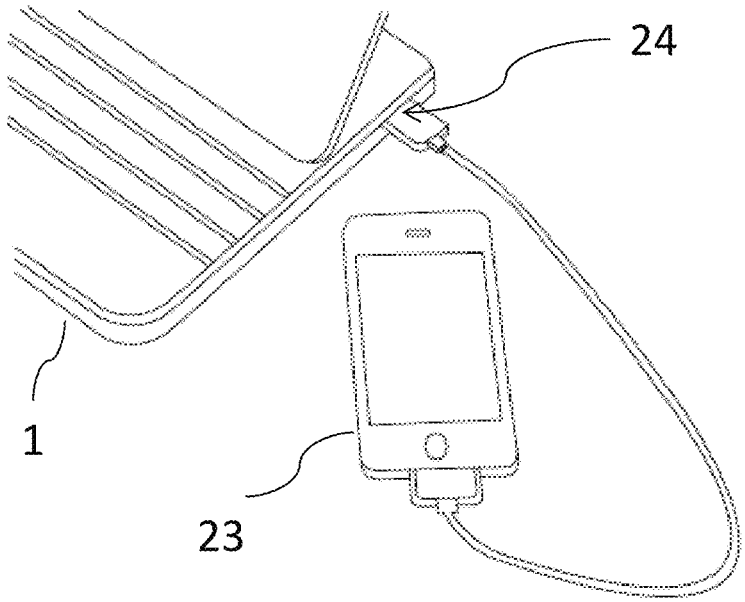
FIG. 5 illustrates and the mobile electronic tablet devices case, with an external charging port connect to a mobile phone.

Now referring to FIGS. 4-5, an alternative embodiment of the case 1 of the present invention is shown. In this embodiment, the angle adjustment is better illustrated, and there is a built in cooling fan, not illustrated. The case 1 of this embodiment may also be rotated for viewing in portrait or landscape positions. This case 1 also includes a USB charging port 24 for an additional smartphone or table computer, such as an IPAD OR IPHONE, providing additional power as needed to devices 23 external to the case 1. This case 1 embodiment allows the charging of portable electronics on the go, as well as means for keeping the IPAD or other table PC running cooler and extending its life. This case 1 is typically made from stylish synthetic leather, has a built-in rechargeable battery 19, cooling face, the battery having 3,500-17,000 mAh and delivering up to 90 hours of charging time for APPLE devices and other smartphones and tablet computers.

Now referring to FIG. 8, the case 1 of this embodiment, has a harder or less flexible case design and provides for enabling a user to adjust the viewing angle greatly. This embodiment illustrates the use of straps 4-7 at each of the four corners of the device for attaching and retaining it against a case surface. This design ensures that all device ports such as cameras and buttons remain accessible.

Figure 7:
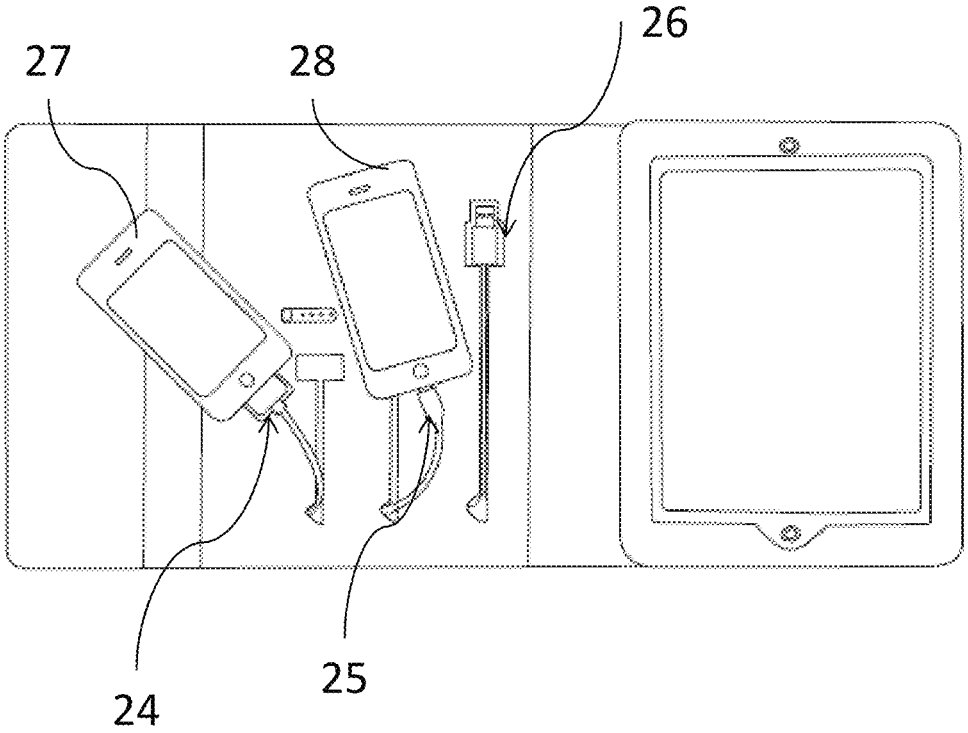
FIG. 7 illustrates the mobile electronic tablet devices case in an open position, with multiple charging cables connect to multiple additional devices.

FIG. 7 illustrates the multiple interchangeable tips 24-26 and their storage within the case 1 for recharging a plurality of devices 27-28 from the case 1. The case includes two universal connectors for charging any two devices at once.

Interchangeable tips may include, 30-Pin, Lightning, 2.5 mm, Mini & Micro USBs. Tips are retained in spaces 12-14 matching their shape and profile. The openings 12-14 in the case 1 provide a compression fit for retaining them until they are desired to be removed.

Figure 6:
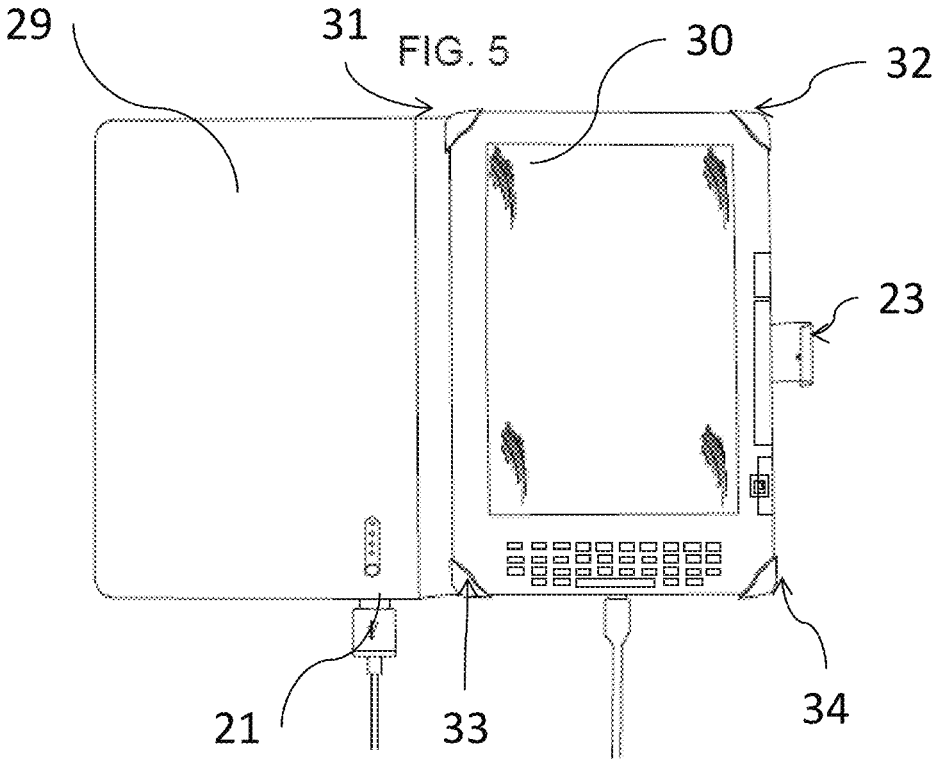
FIG. 6 illustrates the mobile electronic tablet devices case in an open position, with multiple external charging ports.

FIGS. 6 illustrates a case embodiment for charging a KINDLE device 30. This case uses an ultra slim battery that provides over 10 hours of charging time and is hidden below the soft felt lining of the opposing side of the bi-fold case 29 from where the device is retained. The device is retained by straps 31-34 at each of the four corners. A USB port 21 is provided in the battery portion of the case to charge the KINDLE or any other devices, providing additional power whenever it is needed. This case is easily adaptable to various KINDLE models by altering the size and shape to match that of the other models.

Thus, it is appreciated that the optimum dimensional relationships for the parts of the invention, to include variation in size, materials, shape, form, function, and manner of operation, assembly and use, are deemed readily apparent and obvious to one of ordinary skill in the art, and all equivalent relationships to those illustrated in the drawings and described in the above description are intended to be encompassed by the present invention.

Furthermore, other areas of art may benefit from this method and adjustments to the design are anticipated. Thus, the scope of the invention should be determined by the appended claims and their legal equivalents, rather than by the examples given.

The embodiments of the invention in which and exclusive property or privilege is claimed are defined as follows:

1. A personal electronic carrying and charging device comprising:

a bi-fold case;

a first side for securing an electronic tablet device;

a second side retaining a rechargeable battery therein;

an interior surface of the second side providing one or more cavities for securely retaining one or more charging cable; and a protective flap for hiding the charging cables and preventing scratches to a display screen of the electronic tablet device when the case is in a closed position secured to the interior surface of the second side.

2. The device of claim 1, where an electronic tablet device is secured by a compression fitting to the first side.

3. The device of claim 1, where an electronic tablet device is secured by a strap at each corner of the electronic table device securing it to an interior surface on the first side of the case.

4. The device of claim 1, wherein an electronic tablet device includes mobile telephones, personal digital assistants, tablets, c-readers, laptops, cameras, portable navigation systems, personal digital music players, and handheld game consoles.

5. The device of claim 1, further comprising a strap for being secured in a loop secured to the first side of the bi-fold case;

a loop for retaining a strap secured to the second, opposing side of the bi-fold case; and in a closed position the strap is inserted into the loop for securing and closing the case.

6. The device of claim 1, further comprising one or more buttons located on the opposing sides of the case for securing and closing the case.

7. The device of claim 1, wherein a first interior surface is used for securing the case to the electronic tablet device.

8. The device of claim 7, wherein the electronic tablet device is secured by a compression fitting which extends around the entire surface of the electronic tablet device and secures the electronic tablet device against the interior surface and provides compression force all around the entire surface of the electronic tablet device .

9. The device of claim 7, wherein straps are placed at each corner of a square or rectangular device to secure each corner and hold the electronic tablet device against the interior surface.

10. The device of claim 7, wherein a rigid panel is used in combination with the interior surface to hold the electronic tablet device against the interior surface and have it securely retained within the rigid panel.

11. The device of claim 10, wherein the rigid panel is made from a flexible plastic material which enables enough stretch and bend to secure an electronic tablet device to it by compression forces between the edge of the rigid panel and the edge/side of the electronic tablet device.

12. The device of claim 1, wherein when open, the case is folded in half or has an integrated stand on an outer surface for holding the case and electronic tablet device and display screen at an angle on a flat surface.

13. The device of claim 1, wherein the battery is a portable, rechargeable 3500 mAh-17,000 mAh battery integrated into the case; and a printed circuit board (PCB) is connected to the battery to control charging and power distribution to other devices connected to the charging cables.

14. The device of claim 1, wherein the case includes two universal connectors for charging any two devices at once;

interchangeable tips may include, 30-Pin, Lightning, 2.5 mm, Mini & Micro USBs;

tips are retained in spaces matching their shape and profile; and the openings in the case provide a compression fit for retaining them until they are desired to be removed.

15. A personal electronic carrying and charging device comprising:

a bi-fold case;

a first side for securing an electronic tablet device;

a second side retaining a rechargeable battery therein;

an interior surface of the second side providing one or more cavities for securely retaining one or more charging cables; and a second interior surface is covered with a protective flap for hiding charging cables and preventing scratches to a display screen of the electronic tablet device when the case is in a closed position.

16. A personal electronic carrying and charging device comprising:

a bi-fold case;

a first side for securing an electronic tablet device;

a second side retaining a rechargeable battery therein;

an interior surface of the second side providing one or more cavities for securely retaining one or more charging cables;

a first interior surface is used for securing the case to the electronic tablet device; and a rigid panel is used in combination with the interior surface to hold the electronic tablet device against the interior surface and have it securely retained within the rigid panel.

17. The device of claim 16, wherein the rigid panel is made from a flexible plastic material which enables enough stretch and bend to secure an electronic tablet device to it by compression forces between an edge of the rigid panel and an edge or side of the electronic tablet device.

* * * * *